US005381641A

United States Patent [19]

Boja et al.

[11] Patent Number: 5,381,641

[45] Date of Patent: Jan. 17, 1995

[54] BGA FUNNEL

[75] Inventors: Ronilo V. Boja; Mohsen Hosseinmardi, both of San Jose, Calif.

[73] Assignee: Advanced Micro Devices, Inc., Sunnyvale, Calif.

[21] Appl. No.: 157,542

[22] Filed: Nov. 26, 1993

[51] Int. Cl.[6] ..... B65B 39/06; B65B 5/10

[52] U.S. Cl. ..... 53/255; 53/235; 53/284.5

[58] Field of Search ..... 53/255, 235, 284.2, 53/284.4, 284.5, 531, 147, 390; 141/331, 319, 375, 391; 193/2 D, 2 R, 3

[56] References Cited

U.S. PATENT DOCUMENTS

| | | | |
|---|---|---|---|
| 1,415,075 | 5/1922 | Wilbur | 53/255 |
| 2,119,561 | 6/1938 | Smith | 53/255 X |
| 2,656,082 | 10/1953 | Brown | 53/255 X |
| 4,052,838 | 10/1977 | Hilton et al. | 53/255 X |
| 5,205,107 | 4/1993 | Herink | 53/255 |
| 5,209,047 | 5/1993 | Olson | 53/255 X |

*Primary Examiner*—James F. Coan
*Attorney, Agent, or Firm*—Davis Chin

[57] ABSTRACT

A BGA funnel adapted for facilitating the loading of BGA packages into a BGA tube includes an rectangularly-shaped housing (16) and a roofing plate (18). The housing member has a loading end (28), an intermediate portion (19), and an unloading end (30). The intermediate portion of the housing member has a central bore (20) of a substantially U-shaped cross-section extending therethrough. The housing member includes a flat bottom portion (22) and a pair of short vertically extending side walls (24, 26) disposed integrally on each side of the bottom portion. An inwardly tapered channel (38) is formed between the side walls and extends between the loading end and the intermediate portion for receiving the BGA package to be inserted into the BGA tube. Narrow step portions (40, 42) are associated with the inwardly tapered channel for supporting only two side edges of the BGA package so that the bottom surface thereof is suspended freely above the top surface of the inwardly tapered channel. An outwardly tapered channel (50) is formed between the side walls and extends between the intermediate portion and the unloading end. The outwardly tapered channel is adapted for receiving a loading end of the BGA tube. The roofing plate is fixedly secured to the intermediate portion of the housing member so as to prevent the BGA package from being displaced out of the bore.

20 Claims, 2 Drawing Sheets 38
44
32
34
16
20
62
50
48
24
46
22
26
19

18
54
58
56
60

42
44
40
24
26
20
50
5
5
48
22
46

BGA FUNNEL

BACKGROUND OF THE INVENTION

This invention relates generally to packing devices and more particularly, it relates to a BGA funnel of a novel configuration which is adapted for facilitating the loading of ball grid array (BGA) packages into a BGA tubular carrier.

In recent years, the miniaturization of integrated circuit chips has progressed significantly, and small-sized, rectangular plate-shaped parts of the type having no leads, such as pin grid array packages, have been coming into extensive use. Some of these types of pin grid array package structures are formed with solder balls on their bottom surface rather than with external terminal pins and are referred to as "ball grid arrays" (BGA) packages. BGA packages of this type have extra-ordinarily small outer dimensions. For example, a BGA package having 165 solder bells on its bottom surface may have dimensions of about 23.0 mm (in length) ×23.0 mm (in width) ×2.13 mm (in thickness). It is therefore quite difficult to store and/or transport a large number of these BGA packages in a predetermined arrangement. Moreover, it is extremely time-consuming to manually mount such BGA packages one-by-one onto a printed circuit board as is done in the case of conventional larger circuit components.

As a result, there has arisen a need for chip carriers or containers for housing and/or shipping these BGA packages so as to facilitate their storage and transportation from an integrated circuit chip manufacturer's site to an assembly station at a customer's site where automatic equipment functions to remove the BGA packages from the chip carrier and to mount the BGA packages onto a printed circuit board (PCB) or the like. Further, the chip carrier may also function so as to bring different types of electrical components to the assembly station in proper order for sequential assembly operations.

In order to function properly, the chip carriers must be capable of transporting the components placed therein and then, at the proper location (i.e., customer's site) be capable of being quickly and positively opened so that the components can be easily removed for assembly purposes. In addition, the chip carrier must also be able to provide a degree of protection for the sensitive components to be transported therein with respect to contamination, electrostatic discharge (ESD), temperature changes and mechanical shock.

Conventionally, the BGA packages have been housed and shipped in carrier trays of the type having a plurality of separate compartments or pockets for holding them and protecting the same against physical damage or contamination during handling and shipping. One of the disadvantages of the prior art carrier trays is that they require the use of an expensive "pick and place" mechanism to perform the function of picking up the individual BGA packages from the separate compartments of the carrier tray and placing them in position for surface mounting on a printed circuit board or some other operation. In an attempt to overcome this disadvantage, there has been developed a novel BGA carrier of a tubular construction for storing and shipping of BGA packages in a side-by-side arrangement and adapted for dispensing of the same in a one-by-one fashion under gravity, without the need of an expensive "pick and place" mechanism. Such BGA carrier of this tubular type has been described and claimed in a copending application Ser. No. 08/157,543, filed on Nov. 26, 1993, and entitled "BGA TUBE," which is assigned to the same assignee as the present invention.

In order to facilitate the loading of the BGA packages into the tubular carrier (BGA tube) on a more efficient and effective basis, the present invention provides a BGA funnel which is adapted for connection with the loading end of the BGA tube so as to support and guide the BGA packages during the loading procedures.

SUMMARY OF THE INVENTION

Accordingly, it is a general object of the present invention to provide a BGA funnel which is of a simplified construction and is economical to manufacture and assemble.

It is an object of the present invention to provide a BGA funnel of a substantially rectangular configuration which is adapted for facilitating the loading of BGA packages into a BGA tubular carrier.

It is another object of the present invention to provide a BGA funnel which is adapted for connection with the loading end of the BGA tube so as to support and guide the BGA packages during the loading procedures.

It is still another object of the present invention to provide a BGA funnel which includes means for supporting only two side edges of the BGA packages so that the bottom surfaces thereof are freely suspended above the top surface of a tapered channel.

It is yet still another object of the present invention to provide a BGA funnel which is formed of a rectangularly-shaped housing member and a roofing plate secured fixedly to the intermediate portion of the housing member.

In accordance with these aims and objectives, the present invention is concerned with the provision of a BGA funnel adapted for facilitating the loading of BGA packages into a BGA tube. The BGA funnel includes a rectangularly-shaped housing member and a roofing plate. The housing member has a loading end, an intermediate portion, and an unloading end. The intermediate portion of the housing member has a central bore of a substantially U-shaped cross-section extending therethrough. The housing member includes a flat bottom portion and a pair of short vertically extending side walls disposed integrally on each side of the bottom portion.

An inwardly tapered channel is formed between the side walls and extends between the loading end and the intermediate portion for receiving the BGA packages to be inserted into the BGA tube. Narrow step portions associated with the inwardly tapered channel is provided which supports only two side edges of the BGA packages so that the bottom surfaces thereof are freely suspended above the top surface of the inwardly tapered channel. An outwardly tapered channel is formed between these side walls and extends between the intermediate portion and the unloading end. The outwardly tapered channel is adapted for receiving a loading end of the BGA tube. The roofing plate is fixedly secured to the intermediate portion of the housing member so as to prevent the BGA packages from being displaced out of the bore.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figures 1, 5:
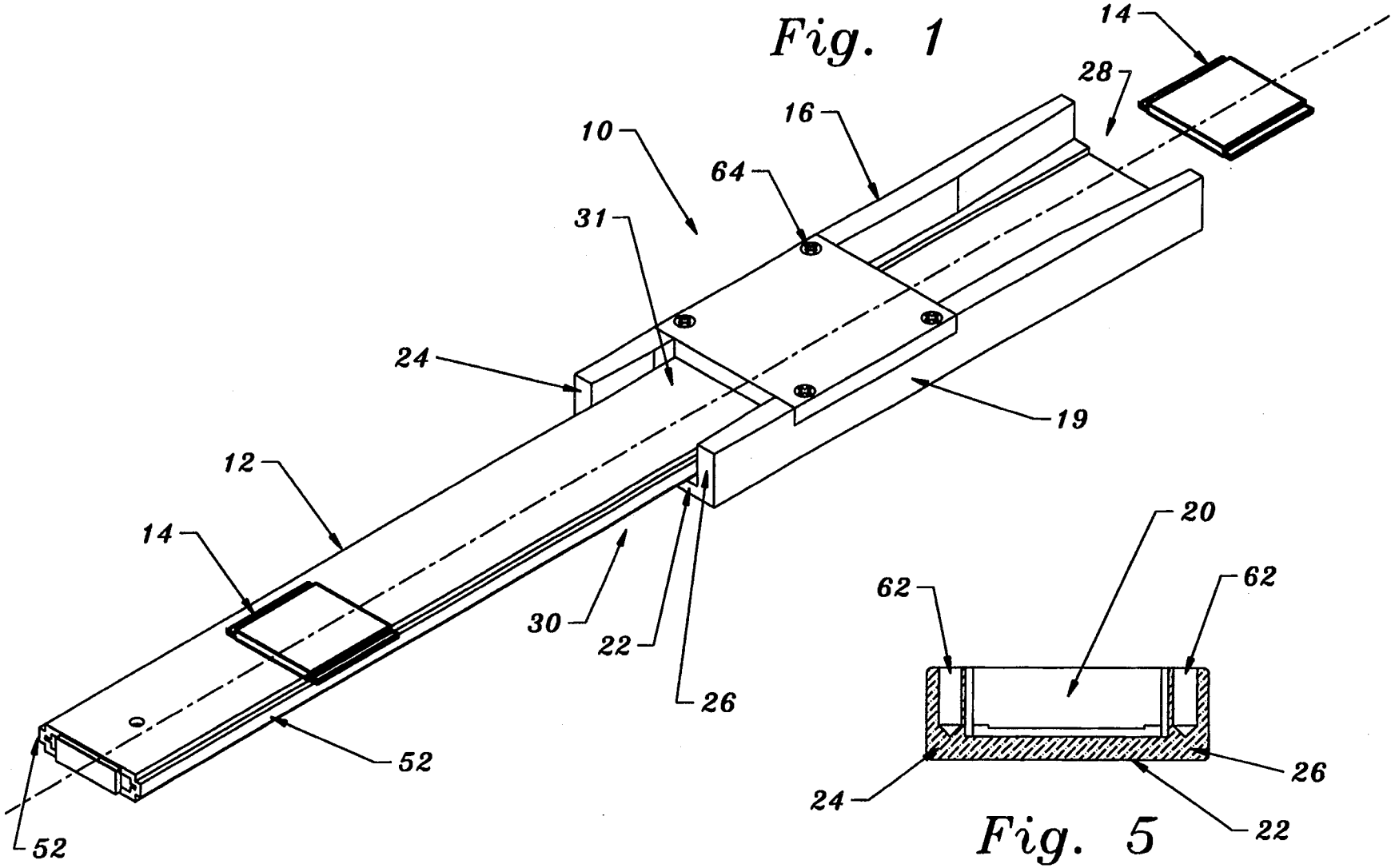
FIG. 1 is a perspective view of a BGA funnel, constructed in accordance with the principles of the present invention, with a BGA package and a BGA tube shown in conjunction therewith.
FIG. 5 is a cross-sectional view, taken along the lines 5—5 of FIG. 4.

Referring now in detail to the drawings, there is shown in FIG. 1 a BGA funnel designated generally by reference numeral 10 and constructed in accordance with the principles of the present invention. The BGA funnel of the present invention is used in conjunction with a BGA tube 12 for facilitating the inserting or loading of ball grid array (BGA) packages 14 (two of which are illustrated) into the BGA tube in a side-by-side arrangement. Each of the BGA packages 14 is of a substantially rectangular shape having four side edges, a top surface, and a bottom surface. The bottom surface is provided with a plurality of solder balls (not shown) arranged in a matrix arrangement.

The BGA funnel 10 is comprised of a rectangularly-shaped bottom housing member 16 and a roofing plate 18 secured fixedly to an intermediate portion 19 of the housing member 16. The intermediate portion 19 of the bottom housing member has a central bore 20 (FIG. 5) which is substantially U-shaped in its cross-section extending therethrough. The funnel is preferably constructed from a metallic material, such as stainless steel, aluminum, or the like so as to be relatively inexpensive in cost, but yet durable in order to provide a long use.

Figures 2, 3, 4:
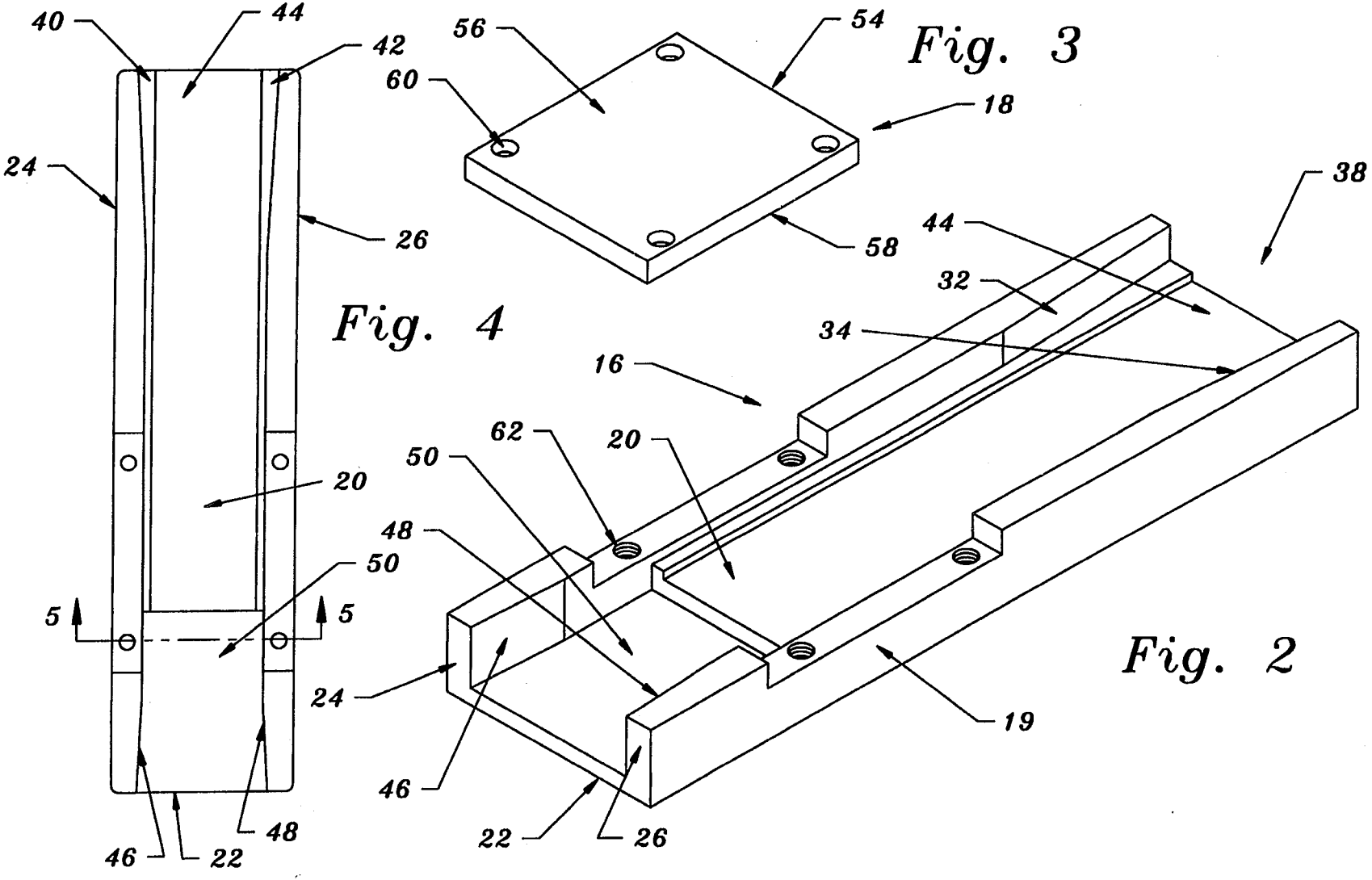
FIG. 2 is a perspective view of the housing member of the funnel of FIG. 1.
FIG. 3 is a perspective view of the roofing plate of the funnel of FIG. 1.
FIG. 4 is a plan view of the housing member of the funnel of FIG. 1.

As can best be seen from FIGS. 1, 2 and 4, the housing member 16 is formed of a longitudinally extending flat bottom portion 22 and a pair of short vertically extending side walls 24 and 26 disposed integrally on each side of the bottom portion 22. The housing member includes a loading end 28 for receiving the BGA packages 14 to be inserted into the BGA tube 12 for filling the same and an unloading end 30 adapted to receive and to securely hold in place the loading end 31 of the BGA tube 12, as is shown in FIG. 1. Opposed inwardly tapering surfaces 32, 34 are formed on the respective side walls 24 and 26 which extend longitudinally between the loading end 28 of the housing member and the intermediate portion 19 thereof so as to define a first tapered channel 38 therebetween. A pair of narrow step portions 40, 42 are formed adjacent the respective tapering surfaces 32, 34 so as to define a straight channel 44 therebetween. It will be noted that the first tapered channel 38 converges gradually into the straight channel 44 which is aligned with the central bore 20.

Opposed outwardly tapering surfaces 46 and 48 are formed in the respective side walls 24, 26 which extend longitudinally between the intermediate portion 19 of the housing member and the unloading end 30 thereof so as to define a second tapered channel 50. It can be seen that the second tapered channel 50 diverges gradually from the intermediate portion 19 to the unloading end 30 so as to facilitate insertion of the loading end 31 of the BGA tube 12 therein. The loading end 12 of the BGA tube is held in the channel 50 by a pressed fit due to the interengagement of the rib-like members 52 formed on the outer side walls of the tube with the opposed surfaces 46 and 48.

As can be seen from FIG. 3, the roofing plate 18 is of a substantially rectangular shape and includes side edges 54, flat top surface 56, and a flat bottom surface 58. The roofing plate 18 includes a plurality of openings 60 which are aligned with threaded holes 62 formed in the vertical side walls 24 and 26 in the intermediate portion 19 of the housing member. Screws 64 are inserted through the opening 60 in the plate 18 and then threaded into the internally threaded holes 62 so as to permanently secure the roofing plate 18 to the housing member 16.

In use, the first tapered channel 38 serves to eliminate the need of precise placement of the BGA packages 12 to be loaded with respect to the straight channel 44. As the BGA package 12 slides downwardly towards the central board 20, the pair of step portions 40 and 42 are used to support only two peripheral edges of each BGA package so that the solder balls on its bottom surface are suspended freely above the top surface of the straight channel 44 and do not contact or engage with any part of the funnel. It serves to avoid the possibility of physical damage to the sensitive parts and bottom surface portions of the BGA packages. Since the roofing plate 18 covers the central bore 20, the BGA packages are prevented from jumping out of the funnel so as to be displaced out of the bore 20. The roofing plate also serves to assist in holding the BGA tube 12 in place so that it remains within the second tapered channel 50. In this manner, the BGA package 12 will be passed smoothly and quickly through the bore 20 and into the loading end 31 of the BGA tube 12.

It should be appreciated by those skilled in the art that the BGA funnel 10 may be formed of various dimensions. However, in the preferred embodiment the housing member has a length of approximately 152.4 mm and a width of approximately 50.8 mm. The vertical walls have a height of approximately 20 mm. Further, the roofing plate has a length of about 50.8 mm and a width of about 40 mm.

From the foregoing detailed description, it can thus be seen that the present invention provides a BGA funnel which is adapted for facilitating the loading of BGA packages into a BGA tubular carrier in a side-by-side arrangement. The BGA funnel of the present invention includes a rectangularly-shaped housing member and a cover plate secured fixedly to the intermediate portion of the housing member.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A BGA funnel adapted for facilitating the loading of BGA packages into a BGA tube, said funnel comprising:

a rectangularly-shaped housing member (16) having a loading end (28), an intermediate portion (19), and an unloading end (30);

said intermediate portion of said housing member having a central bore (20) of a substantially U-shaped cross-section extending therethrough;

said housing member including a flat bottom portion (22) and a pair of short vertically extending side walls (24, 26) disposed integrally on each side of said bottom portion;

an inwardly tapered channel (38) formed between said side walls and extending between said loading end and said intermediate portion for receiving the BGA packages to be inserted into the BGA tube;

narrow step portions (40, 42) associated with said inwardly tapered channel for supporting only two side edges of the BGA package so that the bottom surface thereof is suspended freely above the top surface of said inwardly tapered channel;

an outwardly tapered channel (50) formed between said side walls and extending between said intermediate portion and said unloading end and being adapted for receiving a loading end of the BGA tube; and a roofing plate (18) securely fixed to the intermediate portion of said housing member so as to prevent the BGA package from being displaced out of said bore.

2. A BGA funnel as claimed in claim 1, wherein said housing member and said roofing plate are formed of a metallic material.

3. A BGA funnel as claimed in claim 1, wherein said housing member and said roofing plate are formed of aluminum.

4. A BGA funnel as claimed in claim 1, wherein said housing member and said roofing plate are formed of stainless steel.

5. A BGA funnel as claimed in claim 1, wherein said inwardly tapered channel is defined by opposed inwardly tapering surfaces (32, 34) formed on said respective side walls.

6. A BGA funnel as claimed in claim 5, wherein said outwardly tapered channel is defined by opposed outwardly tapering surfaces (46, 48) formed on said respective side walls.

7. A BGA funnel as claimed in claim 1, wherein said roofing plate includes side edges (54), a flat top surface (56), and a flat bottom surface (58).

8. A BGA funnel as claimed in claim 7, wherein said roofing plate further includes a plurality of openings (60) which are aligned with threaded holes (62) formed in the vertical side walls in the intermediate portion of said housing member.

9. A BGA funnel as claimed in claim 8, further comprising screw means (64) insertable through said openings and being threaded into said holes for permanently securing said roofing plate to said housing member.

10. A BGA funnel adapted for facilitating the loading of BGA packages into a BGA tube, said funnel comprising:

housing means (16) having a loading end (28), an intermediate portion (19), and an unloading end (30);

said intermediate portion of said housing means having a central bore (20) of a substantially U-shaped cross-section extending therethrough;

said housing means including a flat bottom portion (22) and a pair of short vertically extending side walls (24, 26) disposed integrally on each side of said bottom portion;

inwardly tapered channel means (38) formed between said side walls and extending between said loading end and said intermediate portion for receiving the BGA packages to be inserted into the BGA tube;

step supporting means (40, 42) associated with said inwardly tapered channel means for supporting only two side edges of the BGA package so that the bottom surface thereof is suspended freely above the top surface of said inwardly tapered channel means;

outwardly tapered channel means (50) formed between said side walls and extending between said intermediate portion and said unloading end and being adapted for receiving a loading end of the BGA tube; and cover means (18) securely fixed to the intermediate portion of said housing member so as to prevent the BGA package from being displaced out of said bore.

11. A BGA funnel as claimed in claim 10, wherein said housing means and said cover means are formed of a metallic material.

12. A BGA funnel as claimed in claim 10, wherein said housing means and said cover means are formed of aluminum.

13. A BGA funnel as claimed in claim 10, wherein said housing means and said cover means are formed of stainless steel.

14. A BGA funnel as claimed in claim 10, wherein said inwardly tapered channel means is defined by opposed inwardly tapering surfaces (32, 34) formed on said respective side walls.

15. A BGA funnel as claimed in claim 14, wherein said outwardly tapered channel means is defined by opposed outwardly tapering surfaces (46, 48) formed on said respective side walls.

16. A BGA funnel as claimed in claim 10, wherein said cover means includes side edges (54), a flat top surface (56), and a flat bottom surface (58).

17. A BGA funnel as claimed in claim 16, wherein said cover means further includes a plurality of openings (60) which are aligned with threaded holes (62) formed in the vertical side walls in the intermediate portion of said housing means.

18. A BGA funnel as claimed in claim 17, further comprising screw means (64) insertable through said openings and being threaded into said holes for permanently securing said cover means to said housing means.

19. A BGA funnel comprising:

housing means (16) including an intermediate portion (19);

said intermediate portion of said housing means having a central bore (20) of a substantially U-shaped cross-section extending therethrough first tapered channel means (38) being formed on one side of the intermediate portion and being adapted for receiving a BGA package to be inserted into a BGA tube;

second tapered channel means (50) being formed on the other side of said intermediate portion and being adapted for receiving a loading end of the BGA tube; and plate means (18) securely fixed to the intermediate portion of said housing means so as to prevent the BGA package from being displaced out of said bore.

20. A BGA funnel as claimed in claim 19, wherein said plate means includes side edges (54), a flat top surface (56), and a flat bottom surface (58).

* * * * *

UNITED STATES PATENT AND TRADEMARK OFFICE

CERTIFICATE OF CORRECTION

PATENT NO. : 5,381,641

DATED : January 17, 1995

INVENTOR(S) : Ronilo V. Boja et al.

It is certified that error appears in the above-indentified patent and that said Letters Patent is hereby corrected as shown below:

Column 1, line 20, change "bells" to --balls--.

Signed and Sealed this

Twenty-eight Day of March, 1995

*Attest:*

Bruce Lehman

BRUCE LEHMAN

*Attesting Officer*

*Commissioner of Patents and Trademarks*